United States Patent [19]

Takada

[11] Patent Number: 4,800,102

[45] Date of Patent: Jan. 24, 1989

[54] POWDER SPRAYING OR SCATTERING APPARATUS AND METHOD

[75] Inventor: Koichiro Takada, Kanagawa, Japan

[73] Assignee: Nordson Corporation, Amherst, Ohio

[21] Appl. No.: 83,783

[22] PCT Filed: Nov. 28, 1986

[86] PCT No.: PCT/JP86/00609

§ 371 Date: Aug. 24, 1987

§ 102(e) Date: Aug. 24, 1987

[87] PCT Pub. No.: WO87/03226

PCT Pub. Date: Jun. 4, 1987

[30] Foreign Application Priority Data

Jul. 28, 1985 [JP] Japan ..... 60-267971

[51] Int. Cl.[4] ..... B05D 1/12

[52] U.S. Cl. ..... 427/197; 427/282; 427/424; 118/301; 118/308; 118/325

[58] Field of Search ..... 118/301, 308, 325, 24, 118/25; 427/197, 282, 424

[56] References Cited

U.S. PATENT DOCUMENTS

| | | | |
|---|---|---|---|
| 2,672,842 | 3/1954 | Winters et al. | 118/301 X |
| 3,081,698 | 3/1963 | Childress et al. | 427/197 X |
| 3,102,046 | 8/1963 | Bushey | 118/301 X |
| 3,143,960 | 8/1964 | Naczynski | 118/301 X |
| 3,192,796 | 7/1965 | Peeps et al. . | |
| 3,617,331 | 11/1971 | Illsley | 427/282 X |
| 4,095,557 | 6/1978 | Croop et al. | 118/301 |
| 4,102,734 | 7/1978 | Schiffman | 427/282 X |
| 4,269,874 | 5/1981 | Pryor et al. . | |
| 4,583,486 | 4/1986 | Miller | 118/308 |

FOREIGN PATENT DOCUMENTS

| | | |
|---|---|---|
| 550070 | 6/1974 | Switzerland . |
| 951068 | 3/1964 | United Kingdom . |

*Primary Examiner*—Shrive Beck

*Attorney, Agent, or Firm*—Wood, Herron & Evans

[57] ABSTRACT

Apparatus and method for spraying or scattering solid particulate powders onto a substrate includes powder spraying or scattering means, conveyor for supporting and conveying the substrate and rotatable disc member disposed between the spraying or scattering means and the conveyor which is spaced therefrom. The disc member is formed with at least an opening through which powders sprayed or scattered from the spraying or scattering means pass to reach the substrate on the conveyor. In operation, the disc member is rotated and the substrate is moved by the conveyor in the same direction.

8 Claims, 4 Drawing Sheets

FIG. 4A
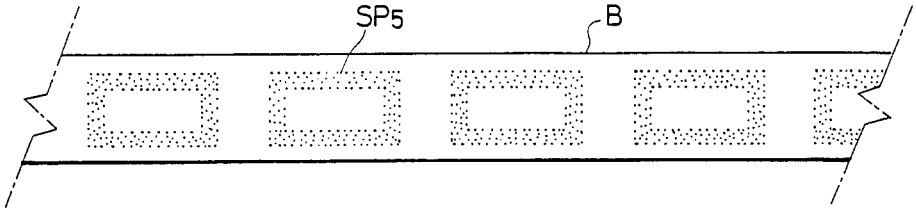
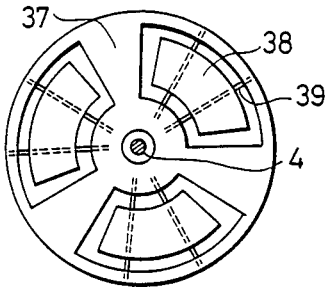
FIG. 4B
FIG. 5A
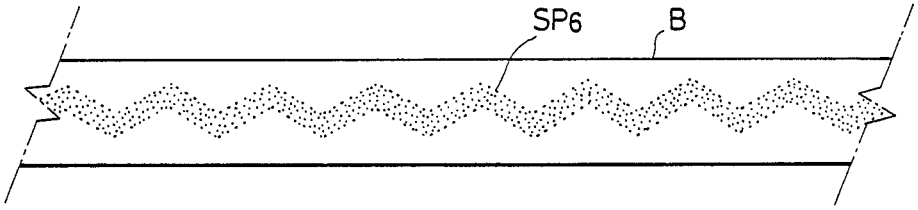
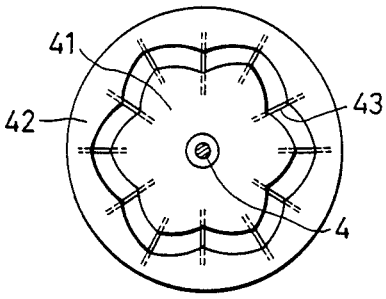
FIG. 5B

POWDER SPRAYING OR SCATTERING APPARATUS AND METHOD

This invention relates to an apparatus for and a method of applying a solid particulate powder material onto a substrate. In particular, the present invention relates to an apparatus for and a method of spraying a solid particulate powder material from a nozzle by compressed air or scattering a solid particulate powder material from a scattering port by free falling.

Where a solid particulate powder material is to be intermittently sprayed or scattered onto an elongated substrate running on a conveyer line, it has heretofore been accomplished by intermittently spraying or scattering the solid particulate powder material by a spray device.

Spraying or scattering the solid particulate powder material from the spray device as described above depends on a severe time of one several thousandth of a second along with the higher speed of the line, and this has required a higher degree of technique and at the same time, has encountered the difficulty that the profile of the pattern of spraying or scattering onto the surface to be coated is blurred.

It is a first object of the present invention to solve the above-noted problems and to provide a method and an apparatus capable of spraying or scattering a solid particulate powder material at a high speed by a simple technique.

It is a second object of the present invention to provide a solid particulate powder material spraying or scattering method and apparatus capable of obtaining a relatively clear-cut profile of spraying or scattering pattern.

It is a further object of the present invention to provide a solid particulate powder material spraying or scattering method and apparatus which readily enable any excess solid particulate powder material to be recovered and reused.

FIG. 4A shows an example of a hollow pattern.

FIG. 4B is a plan view of a circular template for the pattern of FIG. 4A.

FIG. 5A shows an example of a continuous pattern.

FIG. 5B is a plan view of a circular template for the pattern of FIG. 5A.

Figure 1:
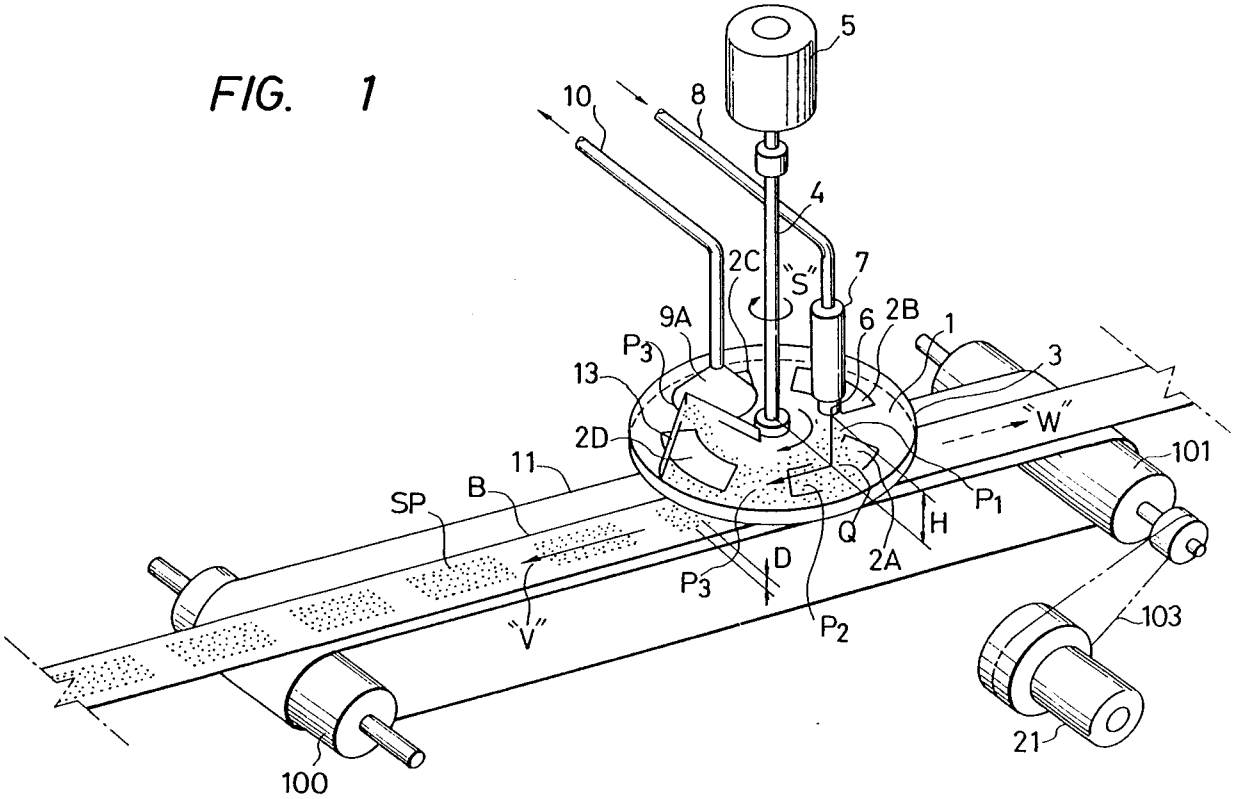
FIG. 1 is an elevational view illustrating the solid particulate powder material spraying method and apparatus according to the present invention.
Figure 2A:
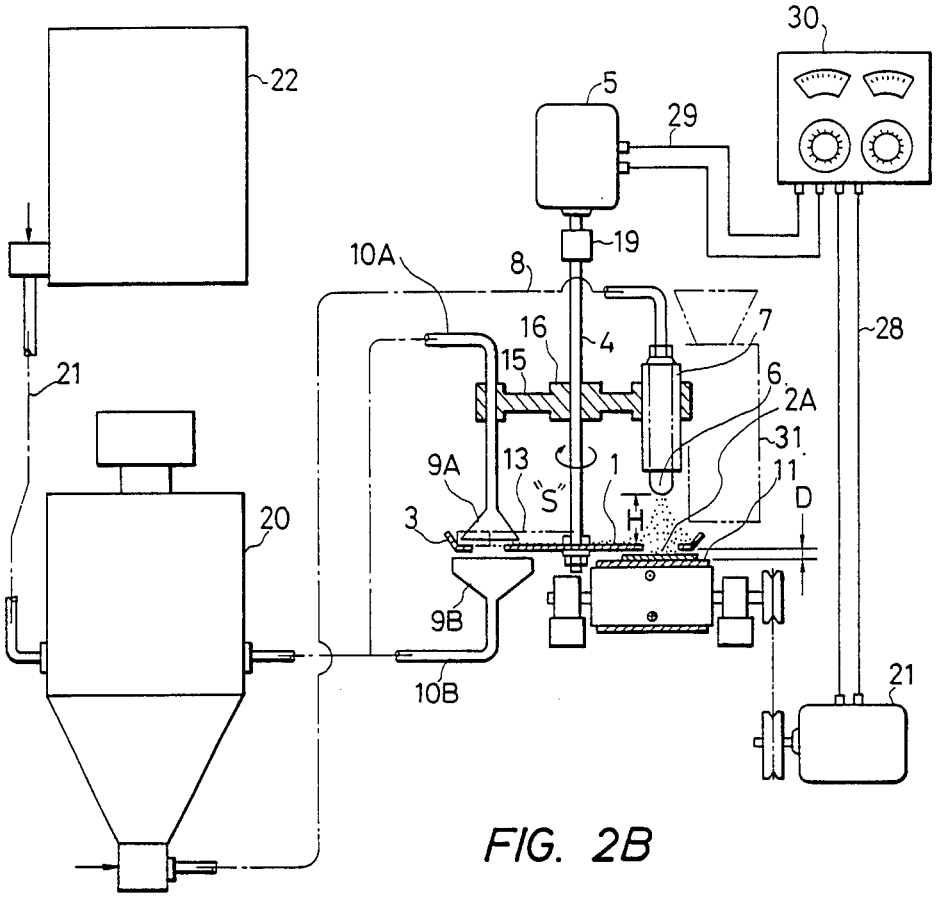
FIG. 2A is a side view illustrating the solid particulate powder material spraying or scattering apparatus according to the present invention.
Figure 2B:
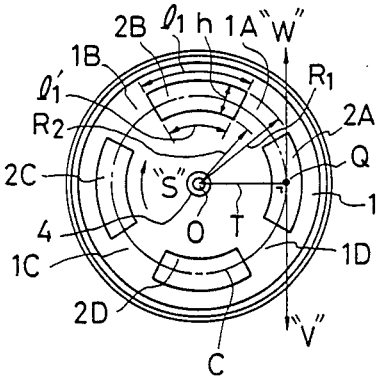
FIG. 2B is a plan view of the circular template portion of the apparatus of FIG. 2A.
Figure 2C:
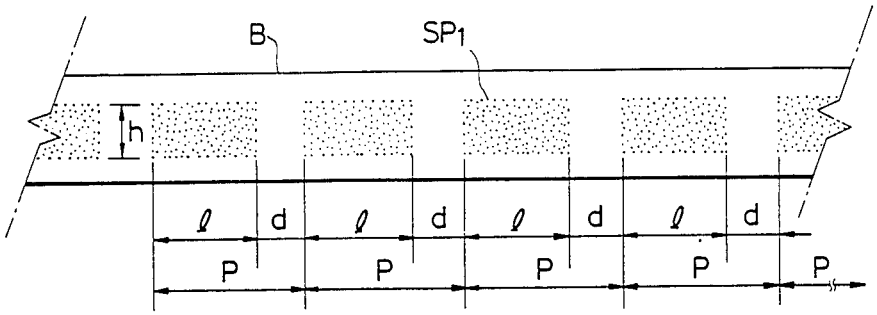
FIG. 2C shows the spraying or scattering pattern on an elongated substrate to be coated on which a solid particulate powder material has been sprayed or scattered by the circular template of FIG. 2B.

Referring to FIGS. 1 to 2B, a rotary shaft 4 of a circular template or disc member 1 forming an essential portion of the apparatus of the present invention is supported by a bearing 16 on the frame 15 (only a portion of which is shown) of the apparatus and further, the shaft 4 is coupled to the shaft of a variable speed motor 5 by a coupling 19. In the circular template 1, a plurality of openings or cut portions 2A, 2B, 2C, . . . spaced apart from one another by a predetermined angle and each having a certain shape or profile are formed along a certain circumference C on the circular template. A rising marginal edge 3 is provided on the outer periphery of the circular template 1. The direction of rotation of the circular template 1 may be either, but in FIG. 1, it is a clockwise direction "S".

At the height "H" above a certain point Q on the circumference C along which said plurality of openings 2A, 2B, 2C, . . . of the circular template 1 are provided, a spray nozzle 6 having a slit-shaped opening for emitting or spraying solid particulate powder material of a linear pattern is provided in opposed relationship with the circular template 1. The nozzle 6 is so arranged that the lengthwise direction of the slit-shaped nozzle opening may be perpendicular to the rotating direction of the circular template 1 and to the direction of the movement of the conveyor or the substrate which will be described later. The spray nozzle 6 is of the so-called air type which injects the solid particulate powders with the aid of compressed air. The solid particulate powder material used in the present embodiment may be various, and may preferably be a water-absorbent polymer solid particulate powder material. A typical water-absorbent polymer is a highly water-absorbent acrylic polymer. The external appearance of such polymer is white powder, which has a characteristic that when brought into contact with water, it absorbs 400 times to 1000 times as much water as its weight and hardly releases the once absorbed water even if more or less pressure is applied thereto. The water-absorbent polymer of this type has recently been widely utilized in water-absorbing fabrics as new products, such as diapers, articles for menstruation, industrial and architectural water-absorbing fabrics, agricultural and horticultural water-keeping fabrics.

The spray nozzle 6 is attached to a spray assembly 7 fixed to a body frame 15 and is connected by a pipe 8 to the delivery portion of a solid particulate powder material recovering filter device 20. The receiving portion of the device 20 is connected by a pipe 21 to the delivery portion of a solid particulate powder supply tank 22.

Below the circular template 1, a conveyor 11 is provided in opposed relationship with the nozzle 6 of the spray assembly 7 and with a spacing D below said point Q on the circular template 1. The conveyor 11 is passed over cylindrical pulleys 100 and 101, of which the driving pulley 101 is driven by a driving variable speed motor 21 through a driving belt 103 indicated by dots-and-dash line. An elongated object B to be coated (in the case of the present embodiment, a non-woven fabric) is placed on the conveyor 11. The object to be coated is not limited to an elongated one, but may also be short ones of predetermined dimensions arranged at predetermined intervals. The direction of movement of the conveyor 11 may be a direction "V" or "W" perpendicular to a straight line T passing through said point Q and the center O of the circular template 1, but in the embodiment illustrated, it is to be understood that the conveyor 11 is moved in the direction "W" in accordance with the direction of rotation "S" of the circular template 1.

On the circular template 1, an upper oversprayed powder sucker 9A and/or a V-shaped scraper 13 is provided at a region substantially symmetrical about the rotary shaft 4 with respect to the spray nozzle 6. A lower oversprayed powder sucker 9B is provided below the circular template 1 in opposed relationship with the upper oversprayed powder sucker 9A or the V-shaped scraper 13. These upper and lower powder suckers 9A and 9B are connected to the receiving side of the recovering filter device 20 by pipes 10A and 10B, respectively. Both of the pipes 10A and 10B are fixed on the body frame 15.

The electric motor 5 for driving the rotary shaft 4 of the circular template 1 and the electric motor 21 for driving the conveyor 11 are electrically connected through conductors 28 and 29, respectively, to a device 30 for setting and tuning the transmission gear ratios of the two motors.

A solid particulate powder material scatterer 31 for uniformly dropping and scattering the solid particulate powder material by its gravity may be provided as indicated by dots-and-dash line, instead of the solid particulate powder material spraying assembly 7. In that case, all the structure except the scatterer 31 is almost similar to what has been described.

Operation will now be described with reference to FIGS. 1 and 2A. First, the circular template 1 and the conveyor 11 are started, and their directions of movement "S" and "V" are identical. However, the peripheral speed of the circular template 1 in its direction of rotation and the movement speed of the conveyor 11 can be selected variously. That is, the peripheral speed $\gtreqless$ the movement speed of the conveyor. The selection of these speeds is determined by the shape and sharpness of the profile with which spraying is effected, the thickness of the layer to be coated, the frequency of intermittence, the amount of spray of the solid particulate powder material, the kind of the product, the production speed, etc. For example, where the layer to be coated is relatively thick and the profile is to be made sharp, it is desirable that the peripheral speed = the movement speed = a relatively low speed, and where the frequency of intermittence is great and the profile also may be unsharp, it is possible that the peripheral speed > the movement speed, and where the frequency of intermittence is relatively small and the quantity of production is great, the peripheral speed < the movement speed. In FIG. 1, the object to be coated is an elongated one, but of course, the present invention is also applicable to single pieces continuously arranged at a predetermined pitch.

When the setting of the two speeds and the supply of the object to be coated onto the line are started in this manner, the spraying operation is started. In FIG. 1, the spraying operation is that of the solid particulate powder material and therefore, powders are sprayed linearly and perpendicularly to the tangential direction of the template 11, from the spray slit nozzle 6 of the spray assembly 7 by the starting of an ejector pump provided in the lower delivery portion of the collecting filter device 20. The solid particulate powder material $P_1$ thus sprayed drops onto the rotating circular template 1, but the powder material having dropped into the opening 2A on the circular template 1 passes through this opening 2A and drops onto the elongated substrate B on the conveyor 11 moved therebelow ($P_2$). That is, such solid particulate powder material is imparted onto the surface of the substrate B as a spray pattern having a profile after the profile of the opening 2A on the rotating circular template 1. Subsequently, a similar operation is performed by the opening 2B on the circular template 1 rotated to below the spray nozzle 6. Thereafter, in a similar manner, the openings 2A, 2B, 2C, . . . on the rotating circular template 1 repeat the same operation endlessly and can attach spray layers having a required profile intermittently onto the surface of the substrate or object at a required pitch.

As described above, the solid particulate powder material having passed through the openings on the circular template 1 is imparted to the substrate B, while the solid particulate powder material having not passed through said openings remains on the circular template 1 ($P_3$). When the circular template 1 makes one half of one full rotation, the solid particulate powder material encounters the fixed V-shaped scraper 13 and is drawn near the V-shaped scraper 13 and collected to the vertex portion of the V-shape, and when the solid particulate powder material encounters a further rotated opening, the powder material drops through that opening and enters the lower solid particulate powder material sucker 9B, and is further air-transported with the air sucked in by the negative pressure in the collecting filter device 20 and is collected into the same device. Further, the remaining solid particulate powder material having passed through the V-shaped scraper 13 is likewise collected into the collecting filter device 20 by the upper solid particulate powder material sucker 9A provided immediately behind the scraper 13. In this manner, the remaining solid particulate powde material on the circular template 1 which has not passed through the openings is all removed by the upper and lower solid particulate powder material suckers 9A and 9B, and the circular template 1 thus cleaned continues to rotate and comes to just beneath the spray nozzle 6, from which the solid particulate powder material is again sprayed onto the circular template 1, and thus, an operation similar to what has been described above is repeated.

The size of the shape of the profile of the solid particulate powder material imparted onto the object to be coated and the size of the shape of the profile of the openings provided on the circular template 1 somewhat differ from each other. The fundamental difference is that in proportion to the radius R of each point in the openings on the circular template, the length of said point on the circumference is determined. That is, the length on the circumference is shorter ($R_1 \rightarrow R_2$) toward the center of the circular template. The reason is that since the peripheral speed is slower toward the center, the time during which the solid particulate powder material is sprayed from the spray nozzle 6 onto the circular template is longer.

In the above-described embodiment, the solid particulate powder material spraying apparatus is first connected from the solid particulate powder material tank 22 to the solid particulate powder material collecting filter device 20 by the pipe 21. Thus, in the present embodiment, any excess or oversprayed solid particulate powder material is recovered and the recovered solid particulate powder material is mixed in the filter device 20 with the fresh solid particulate powder material from the powder supply tank, and the mixture is supplied to the spray assembly 7 through the pipe 8.

Generally, however, the supply tank 22 may be directly connected to the spray assembly 7 without the intermediary of the collecting filter device.

Description will now be made of the relation between the spray pattern and the circular template therefor.

The shape of the profile on the circular template for achieving the arrangement at intervals d (FIG. 2C) of quadrilaterals (h×l) which are the basic form of the spray pattern on the elongated object is such as shown in FIG. 2B. The basis of the shape of such profile is that the straight line in the direction in which the spray pattern flows lies in the tangential direction on the circumference at each point on the circular template, i.e., lies on the circumference. Accordingly, the upper and lower straight lines 1 of each quadrilateral are arcuate on the circular template and become shorter ($1' \rightarrow 1_1'$) toward the center of the circular template in proportion to the radii thereof. However, the height h of the quadrilateral of the spray pattern and the height h of the profile on the circular template do not differ from each other. In FIG. 2B, four profiles are shown on the circular template, but of course, any number of profiles may be provided at equal intervals.

Figure 3A:
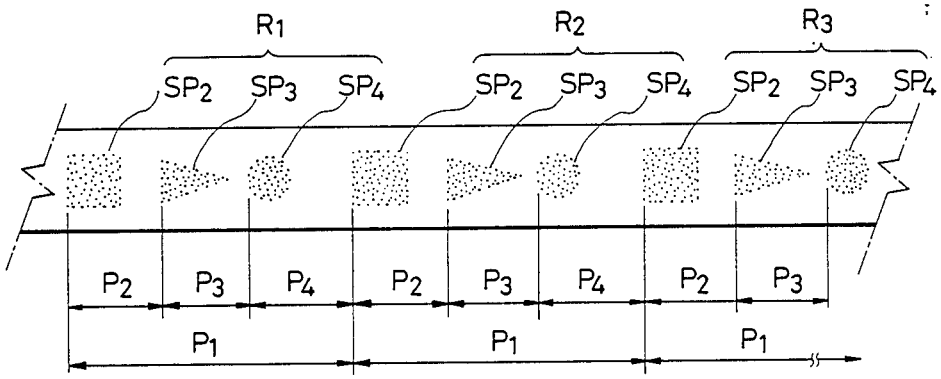
FIG. 3A shows the spraying pattern on an elongated substrate to be coated on which groups having a plurality of different spraying patterns and pitches are sprayed at a predetermined pitch.
Figure 3B:
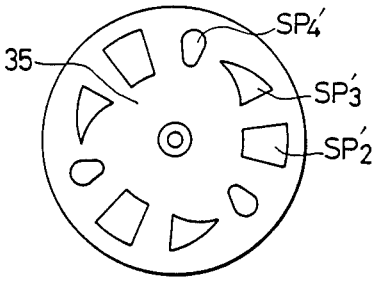
FIG. 3B is a plan view of a circular plate for the pattern of FIG. 3A.

It is possible that a plurality of spray patterns have different pitches and they in turn form groups which are arranged at a predetermined pitch. Reference is now had to FIGS. 3A and 3B. That is, the pitches between a quadrilateral $SP_2$ and a triangle $SP_3$ and between the triangle $SP_3$ and a circle $SP_4$ are different pitches $P_2$, $P_3$ and $P_4$, and these $SP_2$, $SP_3$ and $SP_4$ form a group $R_1$, and next groups $R_2$, $R_3$, $R_4$, . . . are arranged at a predetermined pitch $P_1$. In this case, the shape of the openings on the circular template is such as shown in FIG. 3B.

The interiors of all the above-described spray patterns are immaculate, but hollow spray patterns as shown in FIG. 4A can also be made. In this case, bridges 39 for cores 38 in the openings on the circular template are provided on the back side of the circular template (the side which is adjacent to the substrate), as shown in FIG. 4B. The reason is that the V-shaped scraper and the upper solid particulate powder material sucker are provided in proximity to the upper surface of the circular template and the lower solid particulate powder material sucker may be provided below the lower surface of the circular template with some spacing therebetween.

All the spray patterns in the above-described embodiment are discontinuous, but continuous spray patterns are also possible and the present example is an example of them. See FIG. 5A, in which is shown a zigzag continuous spray pattern. In this case, the shape of the openings of the circular template is separated into an inner ring 41 and an outer ring 42, as shown in FIG. 5B, and bridges 43 for coupling them are provided from the back side of the circular template. The present embodiment is suitable for non-linear continuous spray patterns of irregular shapes.

According to the method and apparatus of the present invention, in the operation of intermittently spraying or scattering a solid particulate powder material onto an elongated substrate, the sprayer or the scatterer need not be operated intermittently but may be operated continuously to thereby make spray patterns intermittently and in addition, any excess solid particulate powder material can be recovered for reuse and also, the length and pitch of discontinuous spray patterns can be changed freely and simply and further, wasteless spray patterns of clear-cut profiles can be obtained.

I claim:

1. A powder spraying or scattering apparatus comprising:

material supply means for spraying or scattering a solid particulate powder material;

horizontal conveyor means disposed beneath said material supply means for supporting and conveying a substrate onto which the solid particulate powder material is to be sprayed or scattered at a predetermined position;

a flat disc member rotatable about a vertical axis and disposed below said material supply means and above said conveyor means and having an opening for passing therethrough the solid particulate powder material sprayed or scattered from said material supply means and applying the solid particulate powder material to said substrate at said predetermined position and a portion for blocking the passage of the solid particulate powder material;

scraper means disposed above and closely adjacent to said flat disc member in a position remote from said material supply means, said scraper means being effective to deflect said solid particulate powder material from the surface of said disc through said opening; and a lower solid particulate powder material receiving member disposed beneath said scraper for collecting material deflected by said scraper through said opening.

2. The powder spraying or scattering apparatus of claim 1 in which said flat disc member is provided with an upstanding peripheral rim for preventing edgewise escape of said powder material.

3. The powder spraying or scattering apparatus of claim 1 further comprising an upper solid particulate powder material sucker disposed above and closely adjacent to said flat disc member adjacent to said scraper means whereby said upper sucker member is effective to remove from said flat disc member any material which is not forced by said scraper means through said opening.

4. The powder spraying or scattering apparatus of claim 3 in which said scraper member comprises a V-shaped scraper blade.

5. The apparatus of claim 1 further comprising first motor means for rotating said horizontal conveyor means and second motor means for rotating said flat disc member, the speed of at least one of said first or second motor means being adjustable relative to the outer of said motor means.

6. A method of applying a solid particulate powder material to a substrate comprising the steps of moving said substrate in a horizontal path, providing a material supply means for spraying or scattering a solid particulate powder material above said path, rotating a flat disc member about a vertical axis, said disc member being interposed between said material supply means and said substrate, discharging said solid particulate powder material through an opening of a predetermined profile formed in said flat rotatable disc member to form a solid particulate powder material pattern of a predetermined shape on the surface of said substrate, and changing the shape of said spray pattern by varying the ratio of the speed of rotation of said flat disc member and the speed of movement of said substrate.

7. The method of claim 6 wherein said solid particulate powder material is continuously discharged from said flat rotatable disc onto said substrate.

8. The method of claim 6 wherein said solid particulate powder material is discharged intermittently from said flat disc member onto said substrate.

* * * * *